US011545791B2

(12) United States Patent
Wei et al.

(10) Patent No.: US 11,545,791 B2
(45) Date of Patent: Jan. 3, 2023

(54) TERMINAL ASSEMBLY AND CONNECTOR

(71) Applicant: Dongguan Luxshare Technologies Co., Ltd, Dongguan (CN)

(72) Inventors: KeChang Wei, Dongguan (CN); Bin Huang, Dongguan (CN); Ming Li, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 15 days.

(21) Appl. No.: 17/322,262

(22) Filed: May 17, 2021

(65) Prior Publication Data

US 2021/0376533 A1 Dec. 2, 2021

(30) Foreign Application Priority Data

May 27, 2020 (CN) ..... 202010459181.X

(51) Int. Cl.
*H01R 13/6586* (2011.01)
*H01R 13/405* (2006.01)
*H01R 13/506* (2006.01)
*H01R 13/6591* (2011.01)

(52) U.S. Cl.
CPC ..... *H01R 13/6586* (2013.01); *H01R 13/405* (2013.01); *H01R 13/506* (2013.01); *H01R 13/6591* (2013.01)

(58) Field of Classification Search
CPC H01R 13/405; H01R 13/506; H01R 13/6581; H01R 13/6585; H01R 13/6586; H01R 13/6591; H01R 13/6593
See application file for complete search history.

(56) References Cited

U.S. PATENT DOCUMENTS 4,846,727 A * 7/1989 Glover ..... H01R 13/6587 439/108
6,231,391 B1 5/2001 Ramey et al.
(Continued)

FOREIGN PATENT DOCUMENTS

TW 201244293 A1 11/2012
WO WO 2019/144440 A1 8/2019

*Primary Examiner* — Oscar C Jimenez
(74) *Attorney, Agent, or Firm* — Birch, Stewart, Kolasch & Birch, LLP

(57) ABSTRACT

A terminal assembly and connector, the terminal assembly comprises a first terminal component, a second terminal component, at least one metal shielding plate, and a metal housing. The first terminal component comprises a plurality of first signal terminals embedded in the first insulating body. The second terminal component comprises a second insulating body and a plurality of second signal terminals embedded in the second insulating body. The second terminal component is disposed opposite to the first terminal component. The at least one metal shielding plate connects with the first terminal component and the second terminal component. The metal shielding plate is disposed between the two adjacent first signal terminals and the two adjacent second signal terminals. The metal housing covers the first terminal component, the second terminal component and at least one metal shielding plate. The at least one metal shielding plate connects with the metal housing.

15 Claims, 18 Drawing Sheets

(56) References Cited

U.S. PATENT DOCUMENTS

| | | | | |
|---|---|---|---|---|
| 8,469,745 | B2 * | 6/2013 | Davis | H01R 12/737 439/607.07 |
| 8,591,260 | B2 * | 11/2013 | Davis | H01R 13/6586 439/607.55 |
| 8,764,464 | B2 | 7/2014 | Buck et al. | |
| 9,225,122 | B1 * | 12/2015 | Evans | H01R 13/6587 |
| 10,461,475 | B2 * | 10/2019 | Little | H01R 13/502 |
| 10,476,210 | B1 * | 11/2019 | Trout | H01R 13/6587 |
| 2018/0219330 | A1 * | 8/2018 | Morgan | H01R 13/6587 |
| 2021/0399500 | A1 * | 12/2021 | Chang | H01R 13/6593 |

* cited by examiner

TERMINAL ASSEMBLY AND CONNECTOR

CROSS REFERENCE TO RELATED APPLICATION

This application claims the priority benefit of Chinese Patent Application Serial Number CN202010459181.X, filed on May 27, 2020, the full disclosure of which is incorporated herein by reference.

BACKGROUND

Technical Field

The present disclosure relates to the technical field of high speed signal transmission and communication, particularly to a terminal assembly and connector.

Related Art

The arrayed installation for conventional high speed terminals requires the terminals to be flake shaped. The configuration of a high speed terminal in the prior arts usually includes a main metal housing, differential signal terminals, and a metal shell. The differential signal terminals are disposed in the metal housing. The metal shell covers the periphery of the differential signal terminals path to block signal radiation, generating a common mode signal to the ground, which is coupled with other differential signals. This not only having the energy to be consumed from its own but also having the other signals and networks to be interfered and damaged. However, the configuration of high speed terminal of the prior art includes an excessive number of parts, resulting in a complicated assembling process, less achievable automated manufacturing, greatly reduced assembling efficiency and unstable assembling quality.

SUMMARY

The embodiments of the present disclosure provide a connector to solve the problem for the configuration of a high speed terminal: an excessive number of parts, complicated assembling process, low assembling efficiency, and less achievable automated manufacturing.

On the first aspect, a terminal assembly is provided, comprising a first terminal component, a second terminal component, at least one metal shielding plate, and a metal housing. The first terminal component comprises a plurality of first signal terminals. The first signal terminal is embedded in the first insulating body. The second terminal component comprises a plurality of second signal terminals and a second insulating body. The second signal terminal is embedded in the second insulating body. The second terminal component is disposed opposite to the first terminal component. The at least one metal shielding plate is connecting with the first terminal component and the second terminal component. The metal shielding plate is disposed between the two adjacent first signal terminals and between the two adjacent second signal terminals. The metal housing covers the first terminal component, the second terminal component and at least one of the metal shielding plates. The at least one of the metal shielding plates is connected to the metal housing.

In the first possible embodiment of the first aspect, the first insulating body comprises at least one first through groove. The second insulating body comprises at least one second through groove. Each of the metal shielding plates is disposed in the corresponding first through groove and the second through groove. Each of the metal shielding plates is connected to the metal housing.

Combining with the first possible embodiment of the first aspect, in the second possible embodiment of the first aspect, two opposite sides of the metal shielding plate respectively comprise a plurality of third positioning columns exposed from at least one of the first through grooves and at least one of the second through grooves. The metal housing comprises a plurality of third positioning holes disposed in the corresponding third positioning holes.

In the third possible embodiment of the first aspect, an inner surface of the metal housing comprises a plurality of soldering bumps soldered to be fixed onto an inner surface of the metal shielding plate.

In the fourth possible embodiment of the first aspect, the metal housing comprises a first housing and a second housing. The first housing is disposed on the first terminal component. On the periphery of the first housing is provided with a plurality of first flanges, each of which comprises a buckle opening. The second housing is disposed on the second terminal component. On the periphery of the second housing is provided with a plurality of second flanges, each of which comprises a buckle corresponding to the buckle opening of each of the first flanges. Each of the second flanges covers the corresponding first flange. Each of the buckles correspondingly buckles into each of the buckle openings.

Combining with the fourth possible embodiment of the first aspect, in the fifth possible embodiment of the first aspect, an end part of each of the first flanges facing the second housing comprises a guiding member. Each of the guiding members extends in a direction away from the corresponding second flange. A side surface of the second insulating body is provided with a plurality of guiding grooves. Each of the guiding members is disposed in the corresponding guiding groove.

Combining with the fourth possible embodiment of the first aspect, in the sixth possible embodiment of the first aspect, one end of the buckle close to the inner side of the second housing comprises an abutting surface abutting against a sidewall of the buckle opening close to the second housing.

Combining with the sixth possible embodiment of the first aspect, in the seventh possible embodiment of the first aspect, the buckle opening comprises an insertion part and a positioning part. The buckle enters the positioning part through the insertion part. The abutting surface abuts against a sidewall of the positioning part. The width of the positioning part is greater than the width of the insertion part. A side edge of the insertion part abuts against two opposite surfaces of the buckle perpendicular to the abutting surface.

Combining with the fourth possible embodiment of the first aspect, in the eighth possible embodiment of the first aspect, a plurality of elastic pieces is disposed on at least one of the plurality of first flanges. The plurality of elastic pieces is in contact with an inner surface of the corresponding second flange.

In the ninth possible embodiment of the first aspect, a plurality of second positioning columns are respectively disposed on a surface of the first insulating body away from the second insulating body and on one side of the second insulating body away from the first insulating body. A plurality of second positioning holes are disposed on the first housing and the second housing. Each of the second positioning columns is inserted into the corresponding second positioning hole. The second positioning column is a hot melt column.

Combining with the first possible embodiment of the first aspect, in the tenth possible embodiment of the first aspect, at least one first connecting bridge is disposed on one side of each of the first through grooves close to the metal housing. At least one second connecting bridge is disposed on one side of each of the second through grooves close to the metal housing. Two sides of the metal shielding plate comprise a notch corresponding to the at least one first connecting bridge and the at least one second connecting bridge. The two sides of the metal shielding plate are tenoned onto the at least one first connecting bridge and the at least one second connecting bridge through the notches.

On the second aspect, a connector is provided, comprising an insulative housing and at least two terminal assemblies according to the first aspect. The terminal assemblies are arranged on inner left and right sides of the insulative housing.

In the embodiments of the present disclosure, when assembling the terminal assembly, it is only necessary to install the first terminal component, the metal shielding plate, and the second terminal component in the metal housing in order, followed by secure-connecting the metal shielding plate with the metal housing by soldering. The present disclosure provides a terminal assembly with a limited amount of parts, which could simplify the assembling process, enhance the assembling efficiency, achieve automated manufacturing, and significantly improve the assembling quality.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
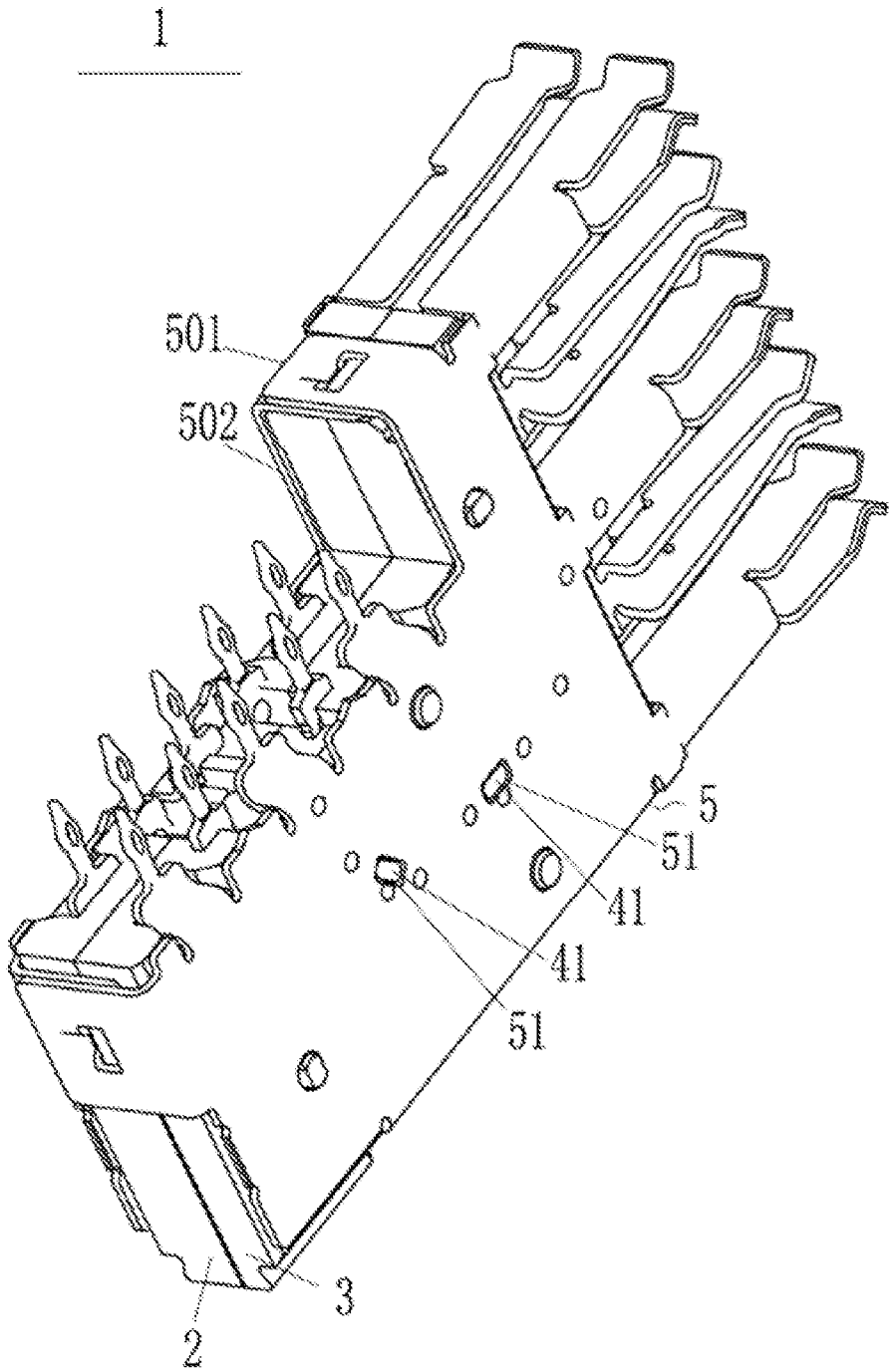
FIG. 1 is a structural schematic diagram of a terminal assembly of the first embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to member a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the disclosure.

Regarding the "first", "second", etc. used in this article, it does not specifically refer to the order or sequence, nor is it intended to limit the application, but only to distinguish between components or operations described in the same technical terms.

Figure 2:
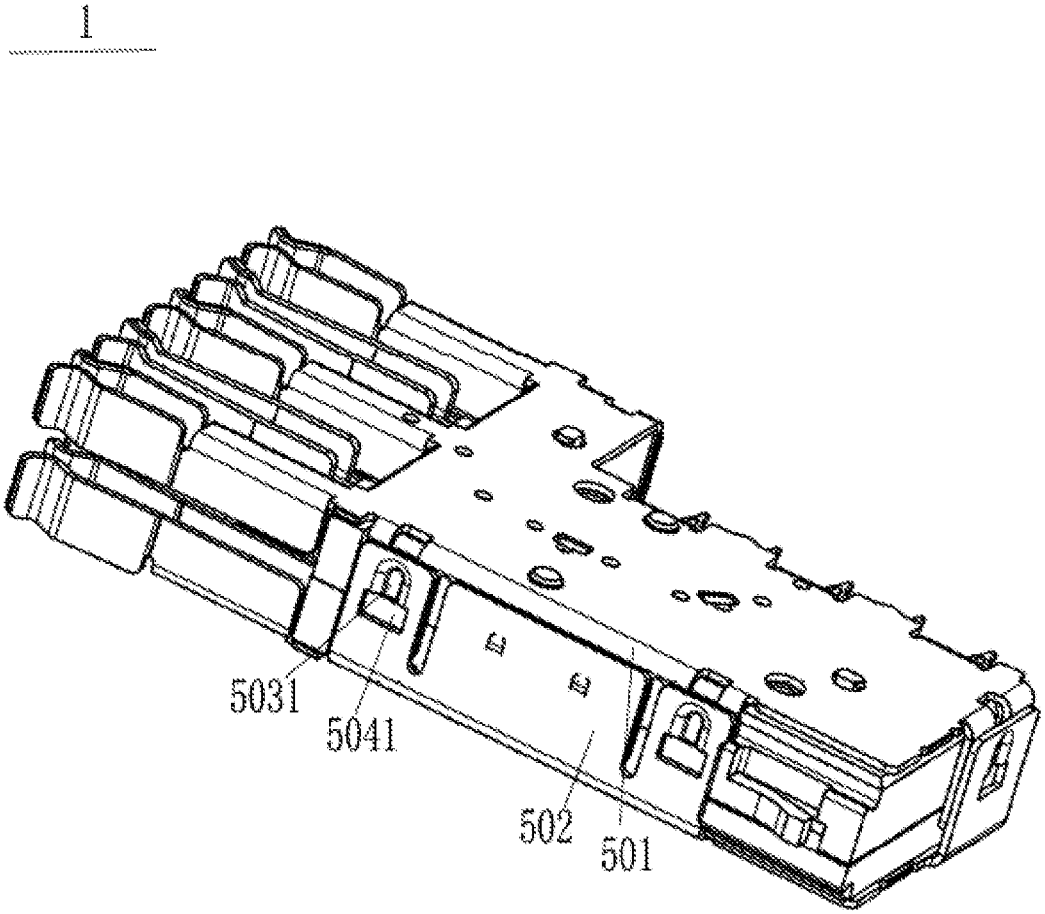
FIG. 2 is a structural schematic diagram of the terminal assembly of the first embodiment of the present disclosure.
Figure 3:
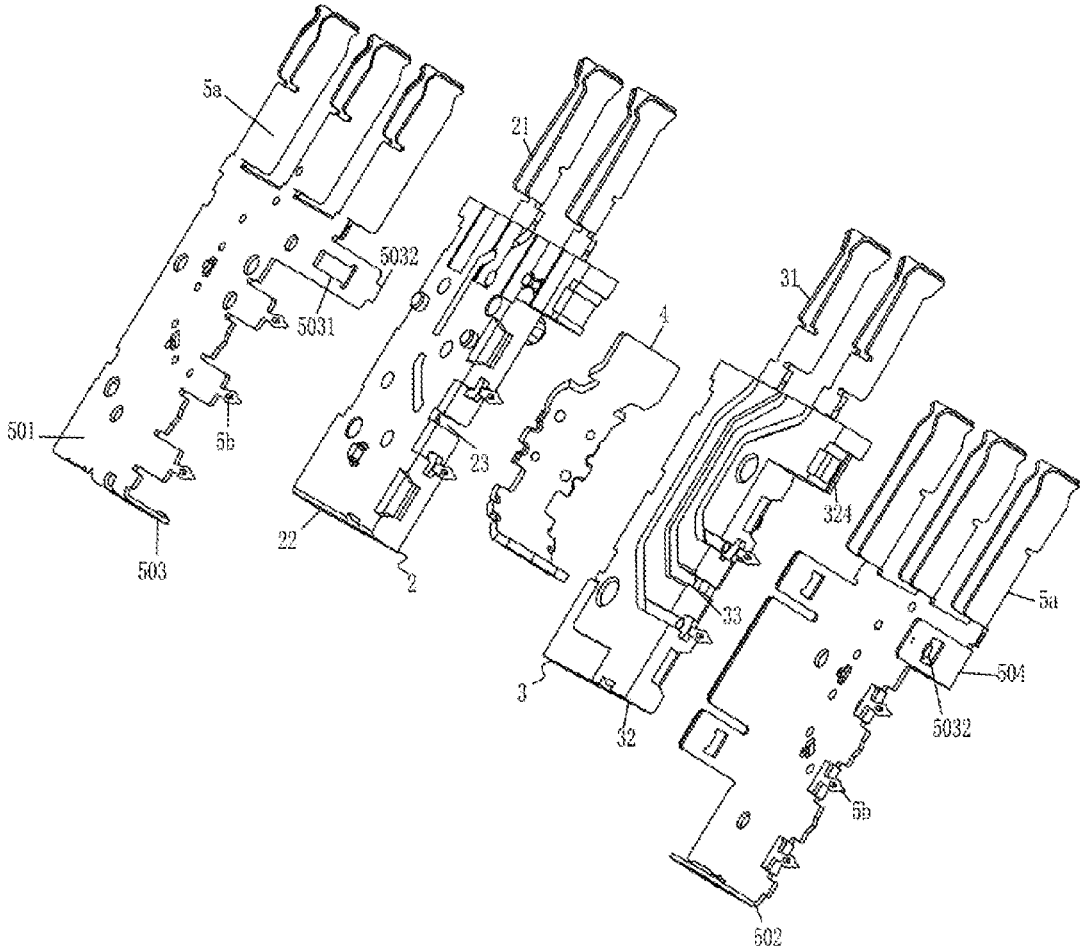
FIG. 3 is an exploded view of the terminal assembly of the first embodiment of the present disclosure.
Figure 4:
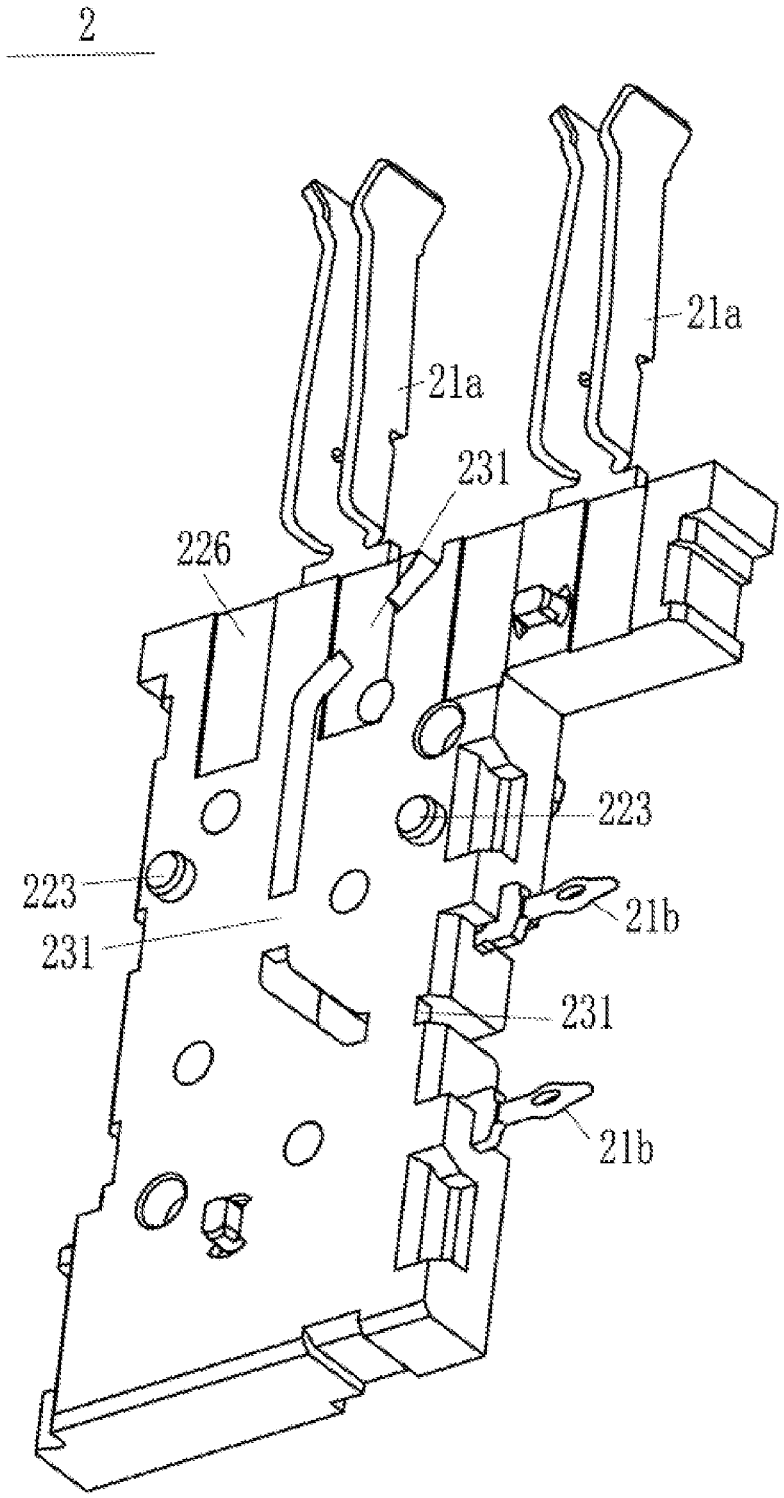
FIG. 4 is a structural schematic diagram of a first terminal component of the first embodiment of the present disclosure.
Figure 5:
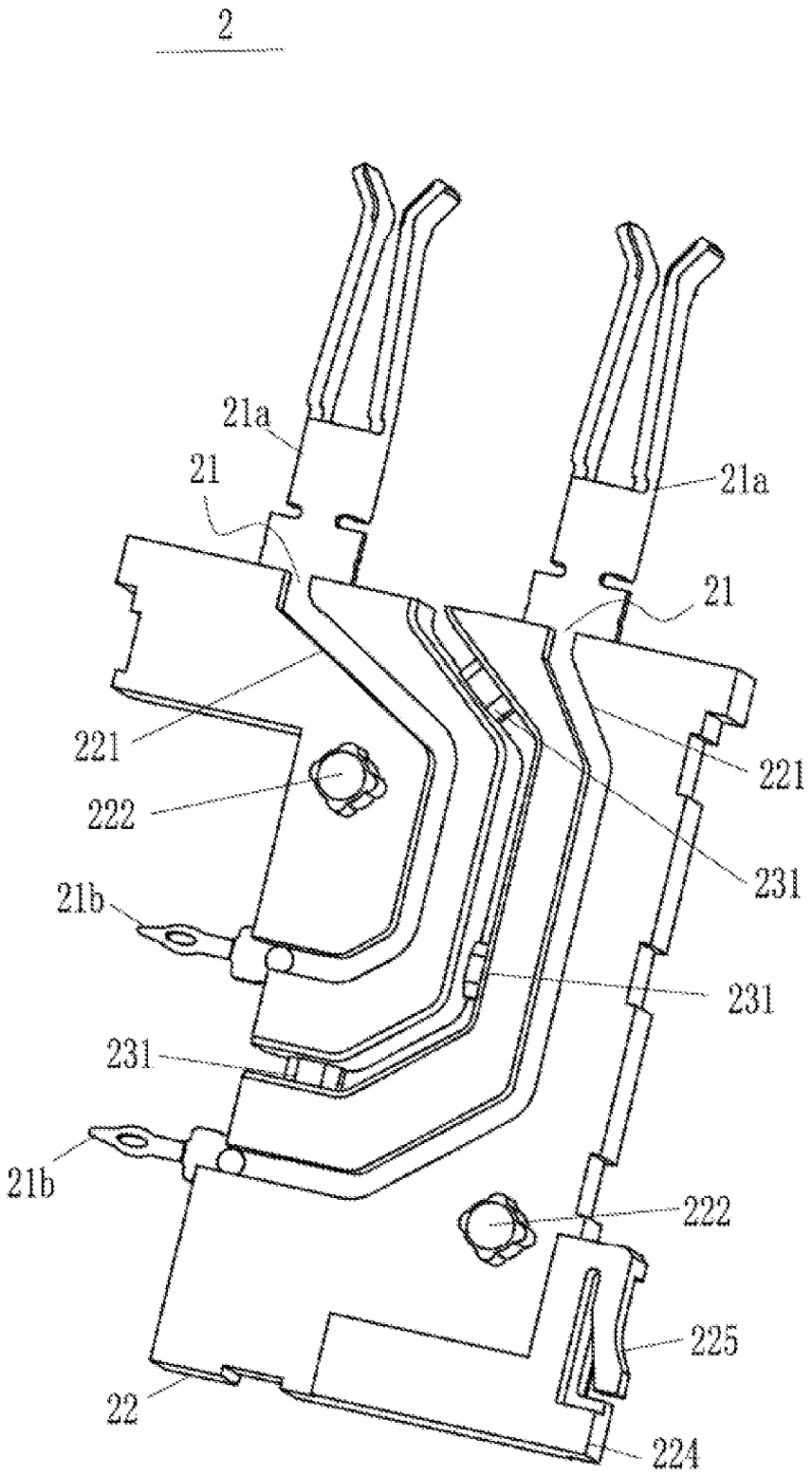
FIG. 5 is a structural schematic diagram of the first terminal component of the first embodiment of the present disclosure.

In the first embodiment of the present disclosure, FIG. 1 and FIG. 2 are structural schematic diagrams of a terminal assembly of the first embodiment of the present disclosure. FIG. 3 is an exploded view of the terminal assembly of the first embodiment of the present disclosure. As shown in FIG. 1 and FIG. 2, the terminal assembly 1 comprises a first terminal component 2, a second terminal component 3, at least one metal shielding plate 4, and a metal housing 5.

Wherein the first terminal component 2 comprises a plurality of first signal terminals 21. FIG. 4 and FIG. 5 are structural schematic diagrams of a first terminal component of the first embodiment of the present disclosure. As shown in FIG. 3 to FIG. 5, The first terminal component 2 of this embodiment further comprises a first insulating body 22. The plurality of first signal terminals 21 is embedded in the first insulating body 22. Each of the first signal terminals 21 comprises a first plugging end 21*a* and a first connecting end 21*b*. The first plugging end 21*a* and the first connecting end 21*b* respectively protrudes from the first insulating body 22. The first plugging end 21*a* is used for electrically contacting with a mating connector. The first connecting end 21*b* is used for being soldered to the circuit board. The first insulating body 22 comprises at least one first through groove 23 laterally penetrating the first insulating body 22, but it is not limited thereto. In one embodiment, the first insulating body 22 and the plurality of first signal terminals 21 are integrated as an integral member through injection molding, but it is not limited thereto.

Figure 6:
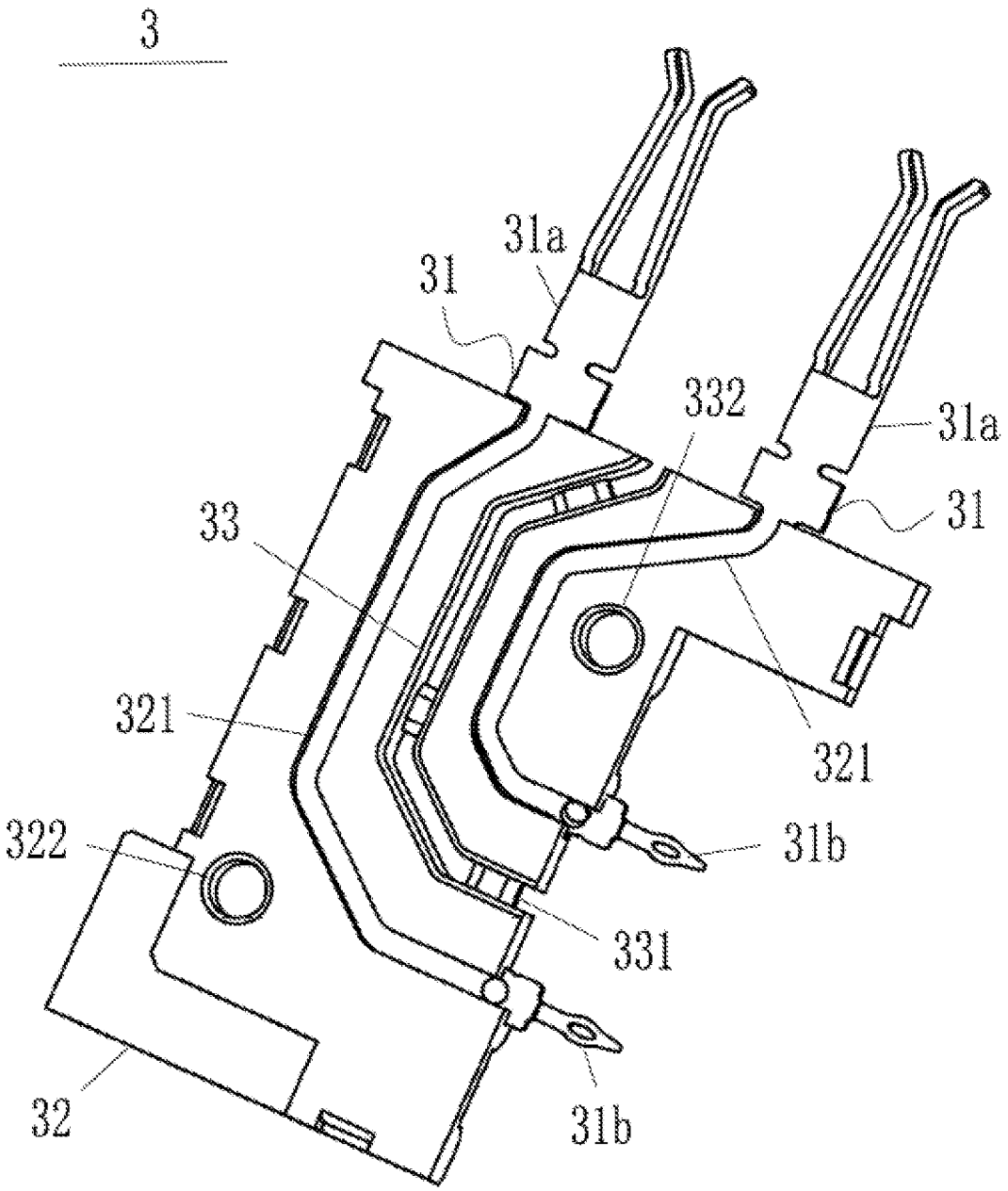
FIG. 6 is a structural schematic diagram of a second terminal component of the first embodiment of the present disclosure.
Figure 7:
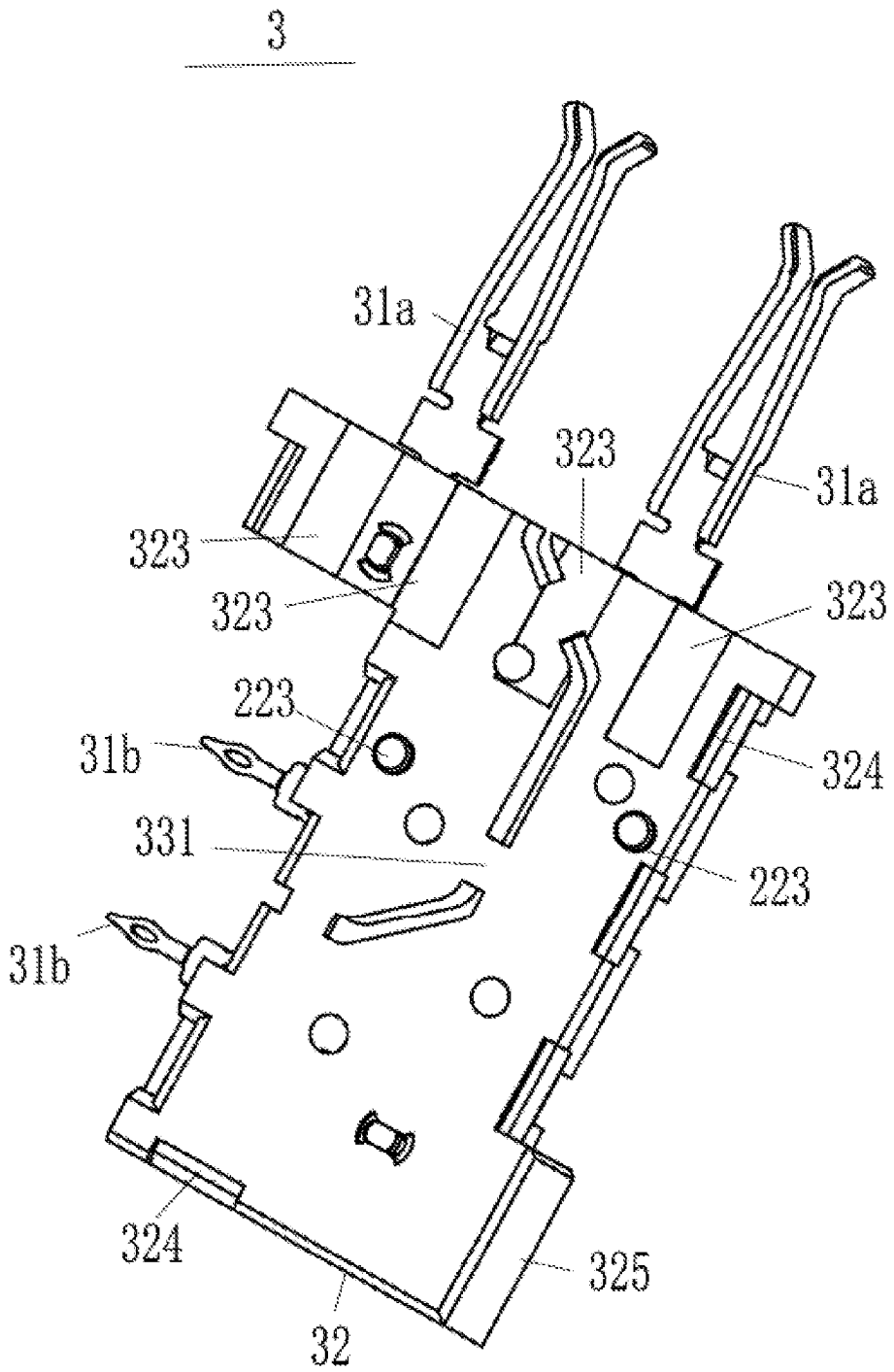
FIG. 7 is a structural schematic diagram of the second terminal component of the first embodiment of the present disclosure.

The second terminal component 3 is disposed opposite to the first terminal component 2. The second terminal component 3 comprises a plurality of second signal terminals 31. The plurality of first signal terminals 21 are disposed in corresponding to the plurality of second signal terminals 31, respectively. FIG. 6 and FIG. 7 are structural schematic diagrams of a second terminal component of the first embodiment of the present disclosure. As shown in FIG. 3, FIG. 6, and FIG. 7, the second terminal component 3 of this embodiment further comprises a second insulating body 32. The plurality of second signal terminals 31 is embedded in the second insulating body 32. The second insulating body 32 corresponds to the first insulating body 22. Each of the second signal terminals 31 comprises a second plugging end 31*a* and a second connecting end 31*b*. The second plugging end 31*a* and the second connecting end 31*b* respectively protrudes from the second insulating body 32. The second plugging end 31*a* is used for electrically contacting with a mating connector. The second connecting end 31*b* is for being soldered to the circuit board. The second plugging end 31*a* of each of the second signal terminals 31 corresponds to the first plugging end 21*a* of each of the first signal terminals 21 and is disposed on the same side. The second connecting end 31*b* of each of the second signal terminals 31 corresponds to the first connecting end 21*b* of each of the first signal terminals 21 and is disposed on the same side. The second insulating body 32 comprises at least one second through groove 33 penetrating the second insulating body 32. The second through groove 33 is aligned with the first through groove 23, but it is not limited thereto. In one embodiment, the second insulating body 32 and the plurality of second signal terminals 31 are integrated as an integral member through injection molding, but it is not limited thereto.

At least one metal shielding plate 4 connects with the first terminal component 2 and the second terminal component 3. The metal shielding plate 4 is disposed between two adjacent first signal terminals 21 and between two adjacent second signal terminals 31, so as to separate a plurality of first signal terminals 21 and a plurality of second signal terminals 31. Each metal shielding plate 4 of this embodiment is disposed in the corresponding first through groove 23 and second through groove 33, but it is not limited thereto.

The metal housing 5 covers the first terminal component 2, the second terminal component 3, and at least one metal shielding plate 4. Two opposite sides of the metal shielding plate 4 are connected to the metal housing 5. Back to FIG. 3, the metal housing 5 of this embodiment comprises a plurality of ground plugging ends 5*a*, and a plurality of ground connecting ends 5*b*. The plurality of ground plugging ends 5*a* correspond to a first plugging end 21*a* and a second plugging end 31*a* and are disposed on the same side for itself to be electrically contacted with the mating connector. The plurality of ground connecting ends 5*b* correspond to a first connecting end 21*b* and a second connecting end 31*b* and are disposed on the same side for itself to be fixed onto the circuit board. The metal shielding plate 4 is connected to the metal housing 5 to be grounded to electromagnetically shield the first terminal component 2 and the second terminal component 3.

Practically, as shown in FIG. 3 to FIG. 7, the first terminal component 2 comprises a first insulating body 22 and two first signal terminals 21 embedded in the first insulating body 22. The first insulating body 22 and the two first signal terminals 21 are integrated as an integral member through injection molding. The first insulating body 22 comprises a first through groove 23 disposed between the two first signal terminals 21.

The second terminal component 3 comprises a second insulating body 32 and two second signal terminals 31 embedded in the second insulating body 32. The second insulating body 32 and the two second signal terminals 31 are integrated as an integral member through injection molding. The second insulating body 32 comprises a second through groove 33. The second through groove 33 is disposed between the two second signal terminals 31 and is aligned with the first through groove 23.

The number of metal shielding plates 4 is one. The metal shielding plate 4 is fixedly accommodated in the first through groove 23 and the second through groove 33. The metal housing 5 covers the first terminal component 2, the second terminal component 3, and the metal shielding plate 4. The opposite two sides of the metal shielding plate 4 are connected to the metal housing 5. Since the first terminal component 2 and the second terminal component 3 are injection molded parts, when assembling, it only needs to assemble the first terminal component 2, the metal shielding plate 4, and the second terminal component 3 according to the assembly order, followed by installing them into the metal housing 5. Finally, to solder the metal shielding plate 4 with the metal housing 5. By performing the steps above, the assembling steps can be minimized and the assembling efficiency can be improved to put the automated manufacturing into practice with laser spot soldering as preferred.

Figure 8:
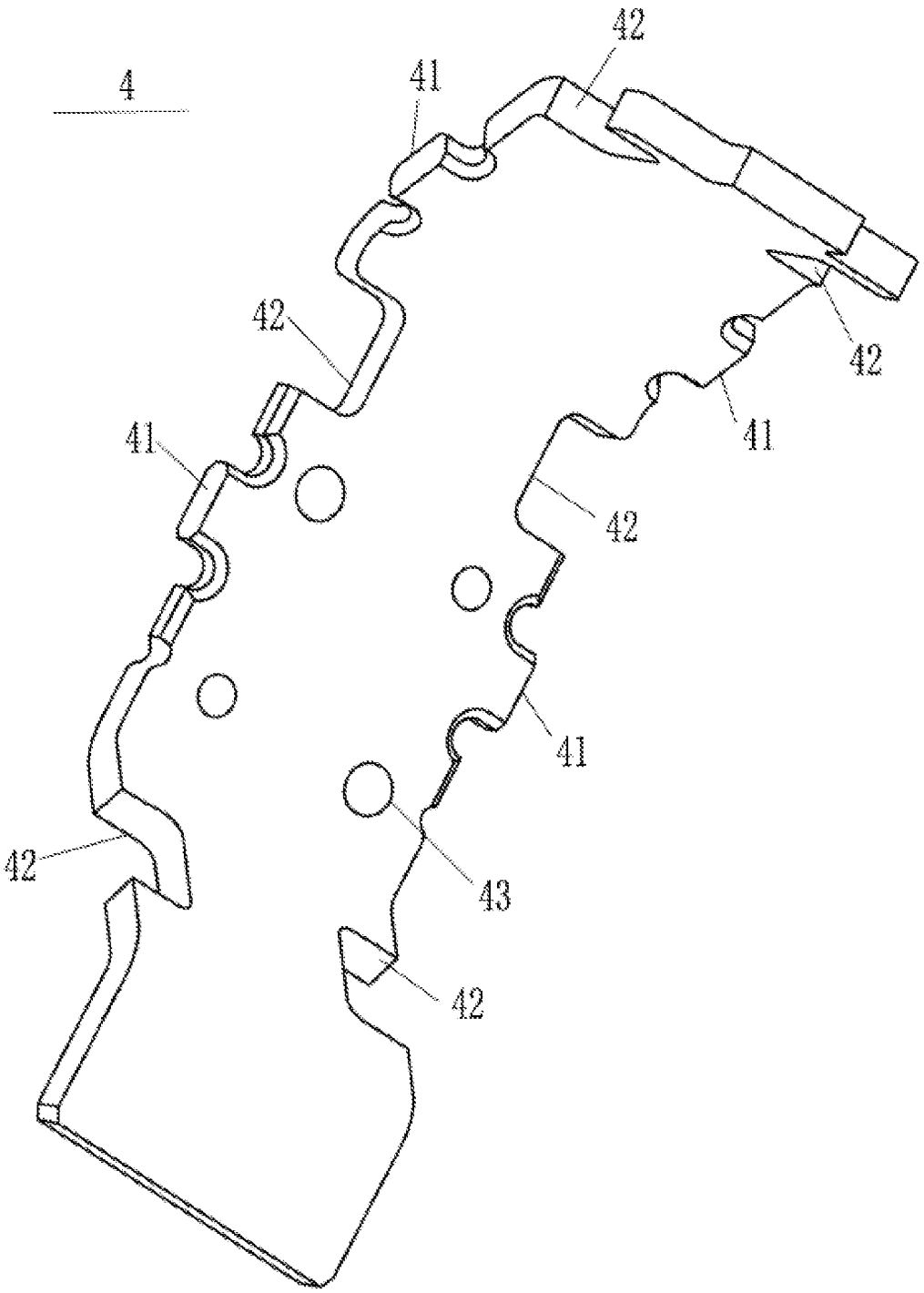
FIG. 8 is a structural schematic diagram of a metal shielding plate of the first embodiment of the present disclosure.

In one embodiment, FIG. 8 is a structural schematic diagram of a metal shielding plate of the first embodiment of the present disclosure. As shown in the figure, a plurality of third positioning columns 41 are disposed on two opposite sides of the metal shielding plate 4 respectively. The plurality of third positioning columns 41 are exposed from the at least one first through groove 23 and the at least one second through groove 33. A plurality of third positioning holes 51 are disposed on the metal housing 5 (see FIG. 1). Each of the third positioning columns 41 is disposed in the corresponding third positioning hole 51. When the plurality of third positioning columns 41 are used to install the metal shielding plate 4, they can be inserted into the corresponding third positioning holes 51 to position the metal shielding plate 4, but it is not limited thereto.

Practically, the two opposite sides of the metal shielding plate 4 are respectively provided with two third positioning columns 41, and the number of third positioning holes 51 is four. It can be seen that the four third positioning holes 51 are respectively disposed on two sides of the metal housing 5, and the two third positioning columns 41 on one side of the metal shielding plate 4 are correspondingly inserted into the two third positioning holes 51 on one side of the metal housing 5.

It should be understood that it only takes two third positioning columns 41 in the above description as an example for the description of the plurality of third positioning columns 41, but the present disclosure would not be limited thereto. The numbers of the plurality of third positioning columns 41 could be different. For example, the numbers of the plurality of third positioning columns 41 could be three, four, five, six or more than six.

In one embodiment, an inner surface of the metal housing 5 comprises a plurality of soldering bumps 52 corresponding to the metal shielding plate 4 in the first through groove 23 and the second through groove 33, for facilitating the laser spot soldering connection between the metal shielding plate 4 and the metal housing 5.

Figure 9:
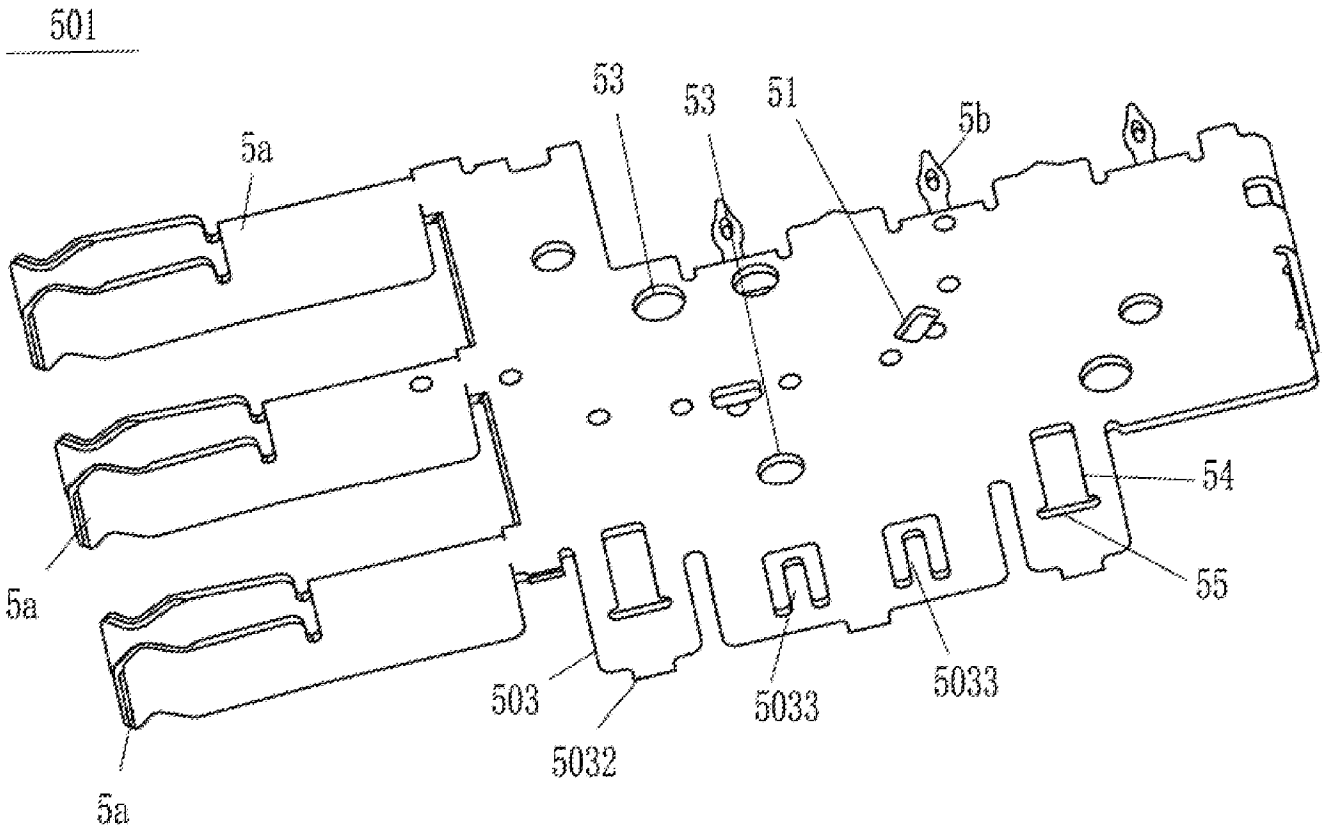
FIG. 9 is a structural schematic diagram of a first housing of the first embodiment of the present disclosure.
Figure 10:
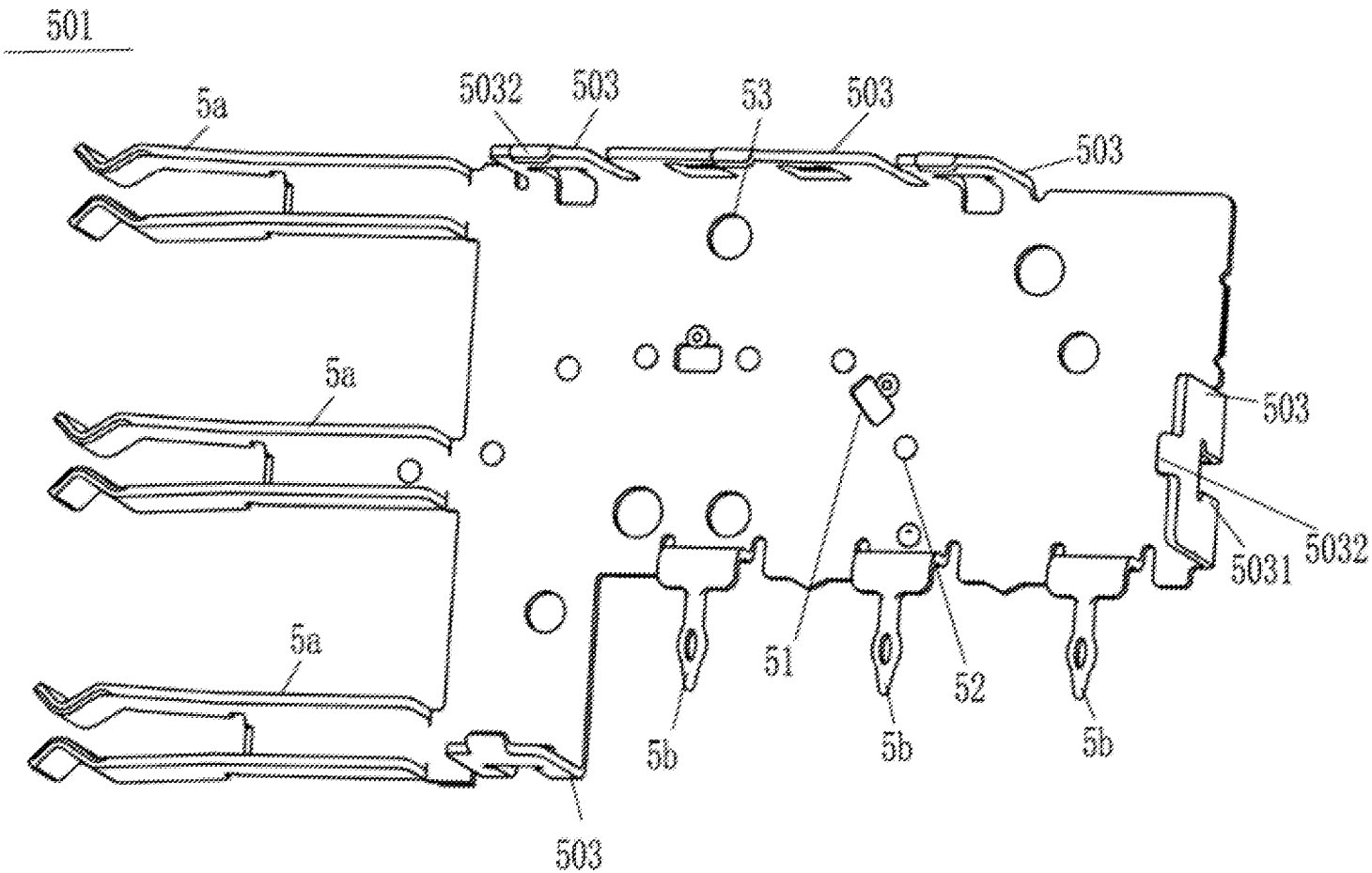
FIG. 10 is a structural schematic diagram of the first housing of the first embodiment of the present disclosure.
Figure 11:
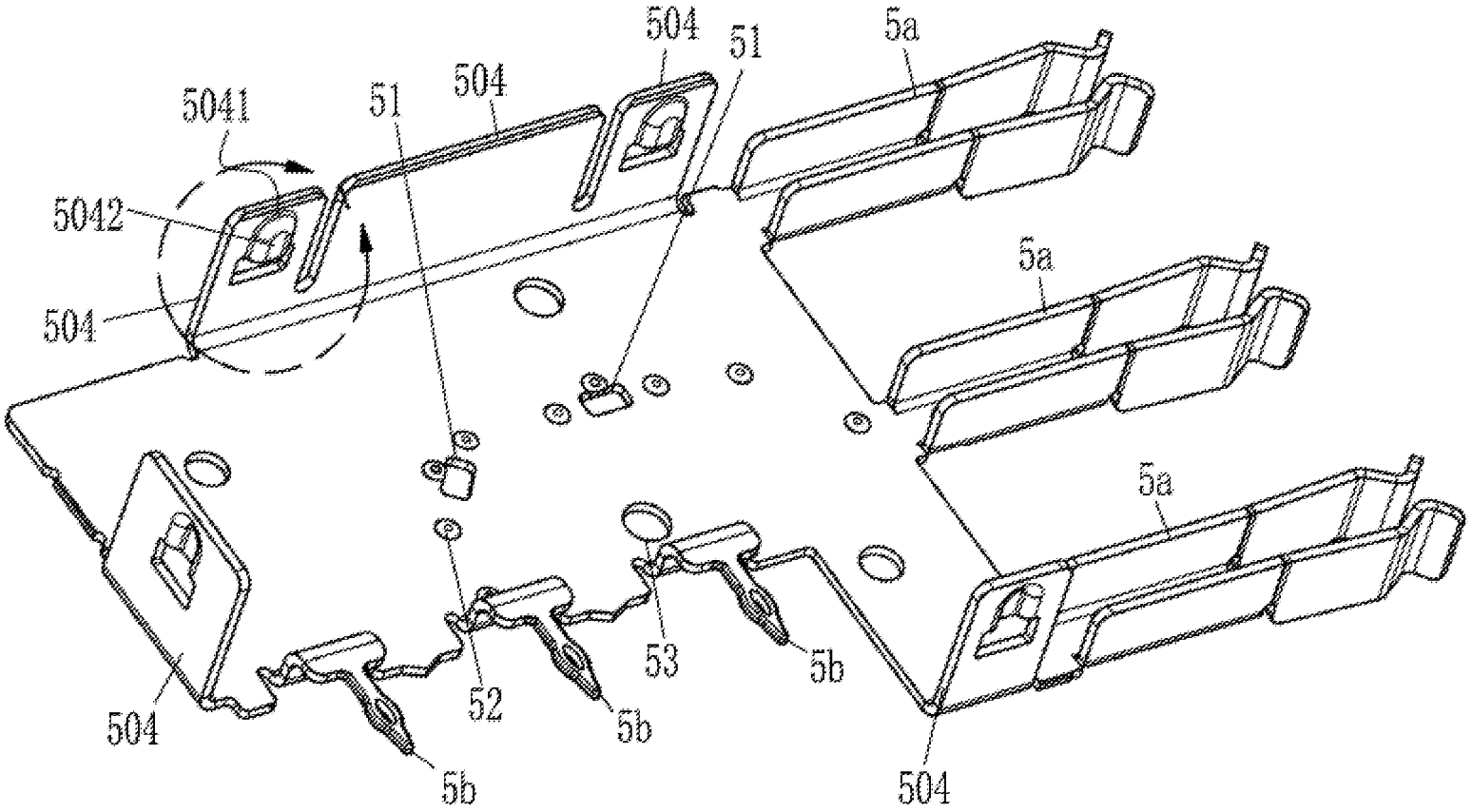
FIG. 11 is a structural schematic diagram of a second housing of the first embodiment of the present disclosure.
Figure 12:
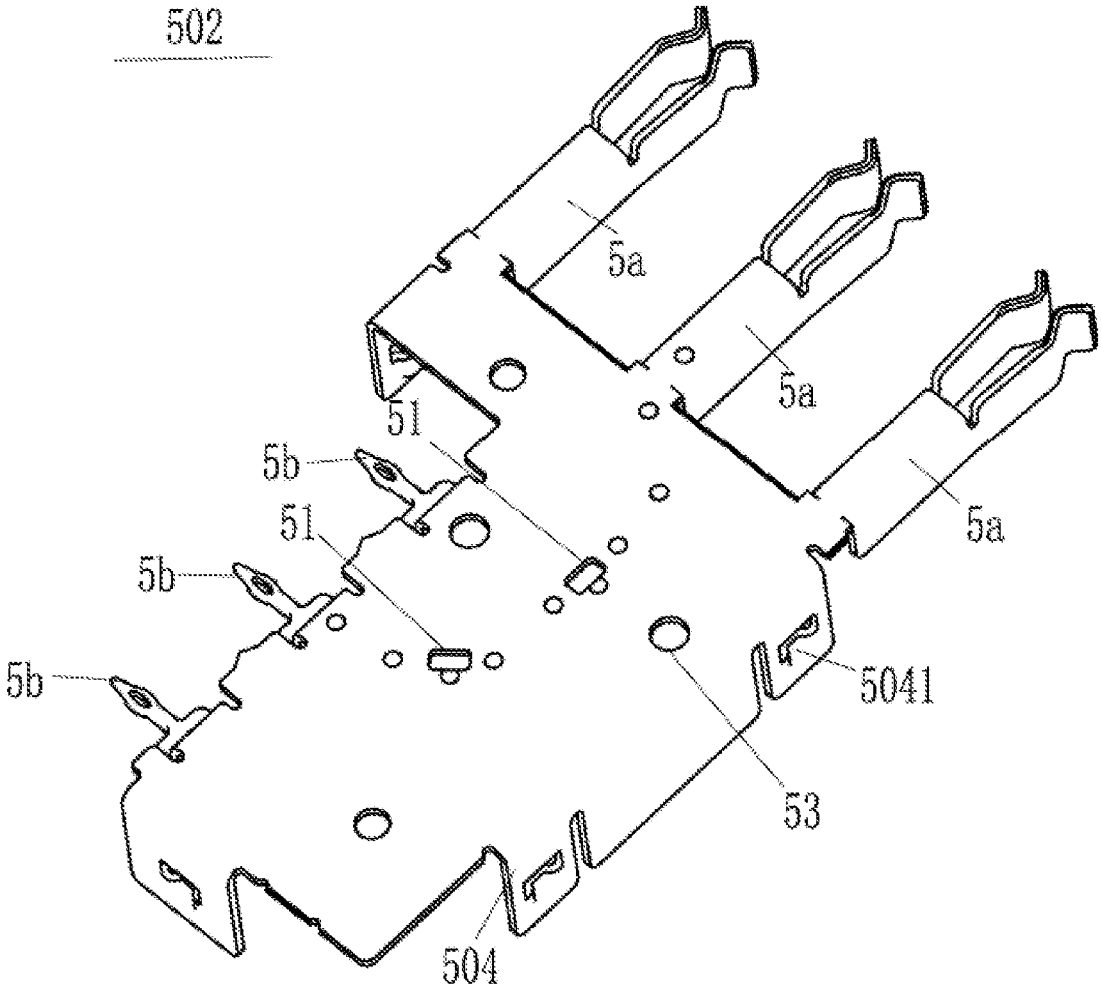
FIG. 12 is a structural schematic diagram of the second housing of the first embodiment of the present disclosure.

Practically, the inner surface of the metal housing 5 comprises a plurality of soldering bumps 52. FIG. 9 and FIG. 10 are structural schematic diagrams of a first housing of the first embodiment of the present disclosure. FIG. 11 and FIG. 12 are structural schematic diagrams of a second housing of the first embodiment of the present disclosure. As shown in FIG. 9 to FIG. 12, the number of the plurality of soldering bumps 52 is twenty. It can be seen that the metal housing 5 comprises a first housing 501 and a second housing 502. Ten soldering bumps 52 are disposed on an inner surface of the first housing 501 of the metal housing 5, and the other ten soldering bumps 52 are disposed on an inner surface of the second housing 502 of the metal housing 5. The ten soldering bumps 52 in the first housing 501 and the ten soldering bumps 52 in the second housing 502 are respectively disposed along a path of the metal shielding plate 4.

When the assembling of the terminal assembly 1 is completed, i.e., when the metal housing 5 covers the first terminal component 2, the second terminal component 3, and the metal shielding plate 4, each metal shielding plate 4 is connected to the first housing 501 on one side protruding from the first insulating body 22, and each metal shielding plate 4 is connected to the second housing 502 on one side protruding from the second insulating body 22. In this way, the metal shielding plate 4 and the first housing 501 and the second housing 502 are laser spot soldered on the twenty soldering bumps 52, and the metal shielding plate 4 is fixedly connected to the metal housing 5.

Due to the difficulty of adopting rigid mechanical configuration for the shielding metal and the metal housing 5 of the prior art, the shielding metal usually uses conductive plastic insert molded parts, which is mainly connected to the metal housing 5 by hot melting contact of the plastic column. In the terminal assembly 1 of this embodiment, the metal shielding plate 4 and the metal housing 5 are laser spot soldered through a plurality of soldering bumps 52 to realize a rigid mechanical connection between the metal shielding plate 4 and the metal housing 5, which increases assembling speed.

It should be understood that it only takes twenty solder bumps 52 in the above description as an example for the description of the plurality of soldering bumps 52, but the present disclosure is not limited thereto.

In one embodiment, the terminal assembly 1 can be used as a wafer for a high speed backplane connector. The first insulating body 22 of the first terminal component 2 and the second insulating body 32 of the second terminal component 3 are vertical wafers. The first signal terminals 21 of the first terminal component 2 are arranged along a vertical surface of the first insulating body 22, and the second signal terminals 31 of the second terminal component 3 are arranged along a vertical surface of the second insulating body 32. The above example is only an embodiment of the present disclosure. The terminal assembly 1 of this embodiment could also be applied to other types of connectors, which would not be repeated again herein.

In one embodiment, back to FIG. 9 to FIG. 12, the first housing 501 is disposed on the first terminal component 2 and comprises a plurality of first flanges 503 on its periphery. Each of the first flanges 503 is provided with a buckle opening 5031. The second housing 502 is disposed on the second terminal component 3 and comprises a plurality of second flanges 504 on its periphery. Each of the second flanges 504 is also provided with a buckle 5041 corresponding to the buckle opening 5031 on each of the first flanges 503.

Each of the second flanges 504 covers the corresponding first flange 503. Back to FIG. 10, at least one of the first flanges 503 of this embodiment is further provided with a plurality of elastic pieces 5033. The plurality of elastic pieces 5033 are in contact with an inner surface of the corresponding second flange 504, so as to increase the stability of the electrical connection between the first flange 503 and the second flange 504, and to prevent the connection from shaking caused by the existence of gaps, but it is not limited thereto.

Figure 13:
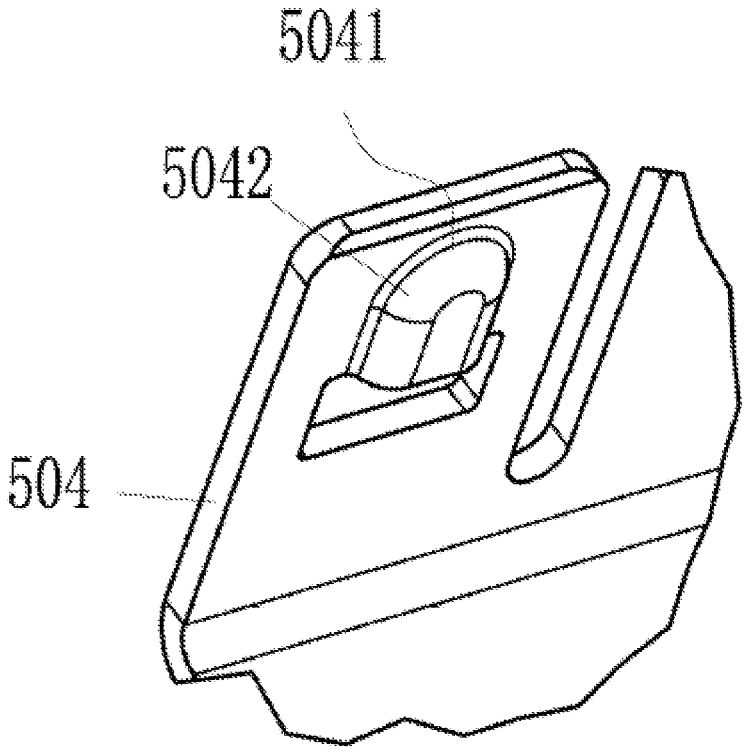
FIG. 13 is an enlarged view of area A of FIG. 11.

Each buckle 5041 is correspondingly embedded into each buckle opening 5031. FIG. 13 is an enlarged view of area A of FIG. 11. As shown in FIG. 11 and FIG. 13, one end of the buckle 5041 close to the inside of the second housing 502 of this embodiment comprises an abutting surface 5042 abutting against a sidewall of the buckle opening 5031 close to the second housing 502, but it is not limited thereto. Back to FIG. 10, the buckle opening 5031 of this embodiment comprises an insertion part 54 and a positioning part 55. The buckle 5041 enters the positioning part 55 through the insertion part 54, and the abutting surface 5042 abuts against a sidewall of the positioning part 55. The width of the positioning part 55 is greater than the width of the insertion part 54. A side edge of the insertion part 54 abuts against the buckle 5041 and two opposite surfaces perpendicular to the abutting surface 5042. So, the interlocking connection between the first housing 501 and the second housing 502 can be realized, but it is not limited thereto.

Practically, as shown in FIG. 9 to FIG. 13, it can be seen that the buckle 5041 is a bump protruding inward from a surface of the second flange 504. The abutting surface 5042 is an outer surface of the bump, the insertion part 54 is a vertical through groove, and the positioning part 55 is a horizontal through groove. The insertion part 54 and the positioning part 55 form a T-shaped groove complex.

Figure 14:
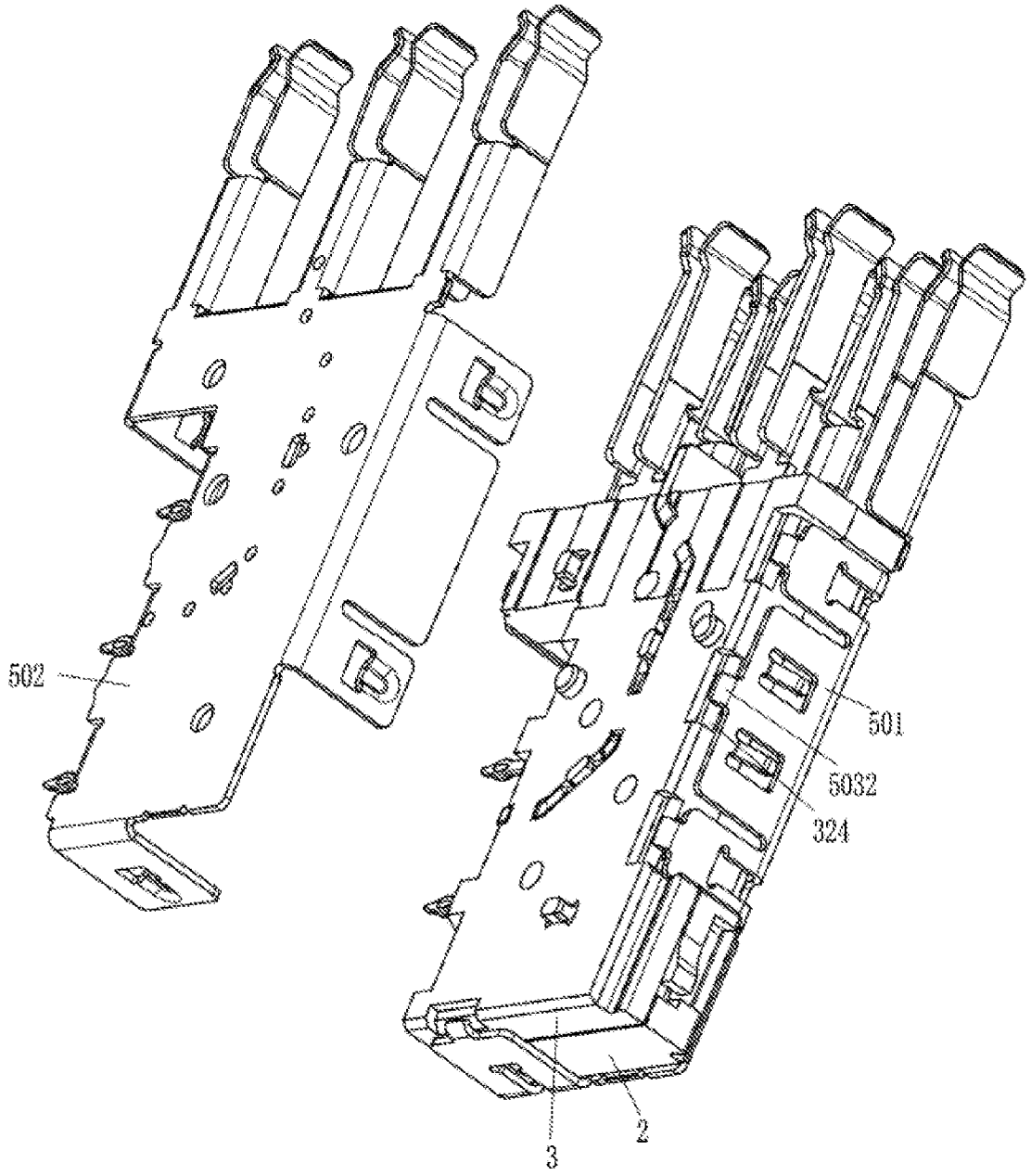
FIG. 14 is a partially exploded view of the terminal assembly of the first embodiment of the present disclosure.

In one embodiment, FIG. 14 is a partially exploded view of the terminal assembly of the first embodiment of the present disclosure. As shown in FIG. 7, FIG. 9, and FIG. 14, an end part of each of the first flanges 503 facing the second housing 502 comprises a guiding member 5032 extending away from the corresponding second flange 504. A side surface of the second insulating body 32 is also provided with a plurality of guiding grooves 324, and each of the guiding members 5032 is disposed in a corresponding guiding groove 324.

Practically, each of the guiding members 5032 is disposed at the top middle position of each first flange 503. Each of the guiding members 5032 is inwardly bent in a bumping arc shape and is buckled in the guiding groove 324 corresponding to a side surface of the second insulating body 32, but it is not limited thereto.

In one embodiment, back to FIG. 5 and FIG. 6, a plurality of first waste guiding grooves 221 are also provided on the first insulating body 22. Each of the first waste guiding grooves 221 is disposed on a surface of the first insulating body 22 adjacent to the second insulating body 32 and extends to the corresponding first signal terminal 21. A plurality of second waste guiding grooves 321 are also provided on the second insulating body 32. Each of the second waste guiding grooves 321 is disposed on a surface of the second insulating body 32 adjacent to the first insulating body 22 and extends to the corresponding second signal terminal 31.

In this embodiment, a plurality of corresponding first waste guiding grooves 221 are disposed on the first insulating body 22, and a plurality of corresponding second waste guiding grooves 321 are disposed on the second insulating body 32 to reduce the dielectric constant, which achieving powerful coupling between the first signal terminal 21 and the second signal terminal 31, but it is not limited thereto.

In one embodiment, back to FIG. 5 and FIG. 6, a plurality of first positioning columns 222 are disposed on a surface of the first insulating body 22 adjacent to the second insulating body 32, and a plurality of first positioning holes 322 are disposed on a surface of the second insulating body 32 adjacent to the first insulating body 22. The plurality of first positioning columns 222 respectively correspond to the first positioning holes 322 and are inserted into the corresponding first positioning holes 322 to allow the first insulating body 22 to position and connect with the second insulating body 32.

Practically, in this embodiment, the number of first positioning columns 222 is two, and the number of first positioning holes 322 is two. The two first positioning columns 222 are diagonally disposed on the first insulating body 22, and the two first positioning holes 322 are disposed diagonally on the second insulating body 32. The two first positioning columns 222 are inserted into the corresponding first positioning holes 322 to allow the first insulating body 22 to position and connect with the second insulating body 32.

It should be understood that the two first positioning columns 222 and the two first positioning holes 322 are only taken as examples above to describe the plurality of first positioning columns 222 and the plurality of first positioning holes 322, but the present disclosure is not limited thereto. The number of the first positioning columns 222 matches the number of the first positioning holes 322. The number of the first positioning columns 222 and the number of the first positioning holes 322 could be any other numbers. For example, three, four, five, six or more than six, respectively.

In one embodiment, back to FIG. 4 and FIG. 7, a surface of the first insulating body 22 away from the second insulating body 32 and a surface of the second insulating body 32 away from the first insulating body 22 are respectively provided with a plurality of second positioning columns 223. A plurality of second positioning holes 53 are also disposed on the first housing 501 and the second housing 502. Each second positioning column 223 is inserted into the corresponding second positioning hole 53.

Practically, the number of second positioning columns 223 of this embodiment is four. It can be seen that the two second positioning columns 223 are disposed on a surface of the first insulating body 22 away from the second insulating body 32. The two second positioning columns 223 are disposed on a surface of the second insulating body 32 away from the first insulating body 22.

When the first insulating body 22 and the second insulating body 32 are installed in the metal housing 5, the first insulating body 22 and the second insulating body 32 are respectively installed on the first housing 501 and the second housing 502, and the four second positioning columns 223 are inserted into the corresponding second positioning holes 53. In this way, the first housing 501 can be preliminarily positioned on the first insulating body 22 and the second housing 502 can be preliminarily positioned on the second insulating body 32. In one embodiment, each second positioning column 223 could be a hot melt column. Before the metal shielding plate 4 to be laser soldered to the metal housing 5, the first housing 501 can be fixed on the first insulating body 22, and the second housing 502 can be fixed on the second insulating body 32 by performing hot melt processing to each second positioning column 223.

It should be understood that the above four second positioning columns 223 are taken as examples for the description of the plurality of the second positioning columns 223, but the present disclosure is not limited thereto. The number of the plurality of second positioning columns 223 could be any other numbers. For example, three, four, five, six or more than six.

In one embodiment, back to FIG. 5 and FIG. 7, a first engaging bump 224 and an elastic arm 225 are disposed on a side surface of the first insulating body 22. One end of the elastic arm 225 is disposed on the first engaging bump 224, and the other end thereof extends away from the first engaging bump 224. The second insulating body 32 is also provided with a second engaging bump 325 adjacent to the first engaging bump 224. When the first engaging bump 224, the second engaging bump 325, and the elastic arm 225 are used for the assembling of the terminal assembly 1 onto a connector insulative housing, they would match with the corresponding structural components of the connector insulative housing to restrict the degree of freedom in the X, Y, and Z axes direction of the terminal assembly 1, wherein the X, Y, Z axes are virtual imaginary degrees of freedom. Z axis is the degree of freedom in the vertical direction of terminal assembly 1, and X and Y axes form the freedom degree in the horizontal direction to which the Z axis is perpendicular to.

In one embodiment, back to FIG. 4 and FIG. 7, a plurality of first retaining grooves 226 are disposed on a surface of the first insulating body 22 away from the second insulating body 32. Each of the first signal terminals 21 is disposed between two adjacent first retaining grooves 226, and the plurality of first retaining grooves 226 respectively form a first retaining space with the first housing 501. A plurality of second retaining grooves 323 are disposed on a surface of the second insulating body 32 away from the first insulating body 22. Each of the second signal terminals 31 is disposed between two adjacent second retaining grooves 323, and the plurality of second retaining grooves 323 respectively form a second retaining space with the second housing 502. When the terminal assembly 1 is installed to the connector body, the structural components of the connector body would interfere with the metal housing 5. As the first retaining space and the second retaining space provide a space for the metal housing 5 to shrink, the metal housing 5 could still have a certain degree of elasticity, but it is not limited thereto.

In one embodiment, refer to FIG. 4 to FIG. 7 again, at least one first connecting bridge 231 is disposed on one side of each first through groove 23 close to the metal housing 5, and at least one second connecting bridge 331 is disposed on one side of each second through groove 33 close to the metal housing 5. Two opposite sides of each metal shielding plate 4 are correspondingly tenoned onto at least one first connecting bridge 231 and at least one second connecting bridge 331 and are connected to the metal housing 5, but it is not limited thereto. Referring to FIG. 8 again, two sides of the metal shielding plate 4 of this embodiment comprise a notch 42 corresponding to at least one first connecting bridge 231 and at least one second connecting bridge 331. Two sides of the metal shielding plate 4 are tenoned on at least one first connecting bridge 231 and at least one second connecting bridge 331 through the notch 42, but it is not limited thereto.

Practically, two sides of the metal shielding plate 4 are tenoned on at least one first connecting bridge 231 and at least one second connecting bridge 331 through the notch 42. As shown in FIG. 4 to FIG. 8, the number of notches 42 is six, the number of at least one of the first connecting bridges 231 is three, and the number of at least one of the second connecting bridges 331 is three. It can be seen that the six notches 42 are symmetrically disposed on two sides of the metal shielding plate 4. Two sides of the metal shielding plate 4 are tenoned on the three first connecting bridges 231 and the three second connecting bridges 331 through the six notches 42.

It should be understood that, in the foregoing, only three first connecting bridges 231 and three second connecting bridges 331 are taken as examples for the description of the plurality of first connecting bridges 231 and the plurality of second connecting bridges 331, but the present disclosure is not limited thereto.

Back to FIG. 8, in one embodiment, a plurality of bumps 43 are disposed on two sides of each metal shielding plate 4. When the metal shielding plate 4 is disposed in a corresponding first through groove 23 and a second through groove 33, the plurality of bumps 43 can be in close contact with an inner wall of the first through groove 23 and the second through groove 33, which is usually interference contact. Thus, the metal shielding plate 4 can be positioned in the first through groove 23 and in the second through groove 33 to prevent it from shaking in the first through groove 23 and the second through groove 33, which stabilizes the assemble of the related components, but this is not limited thereto.

Figure 15:
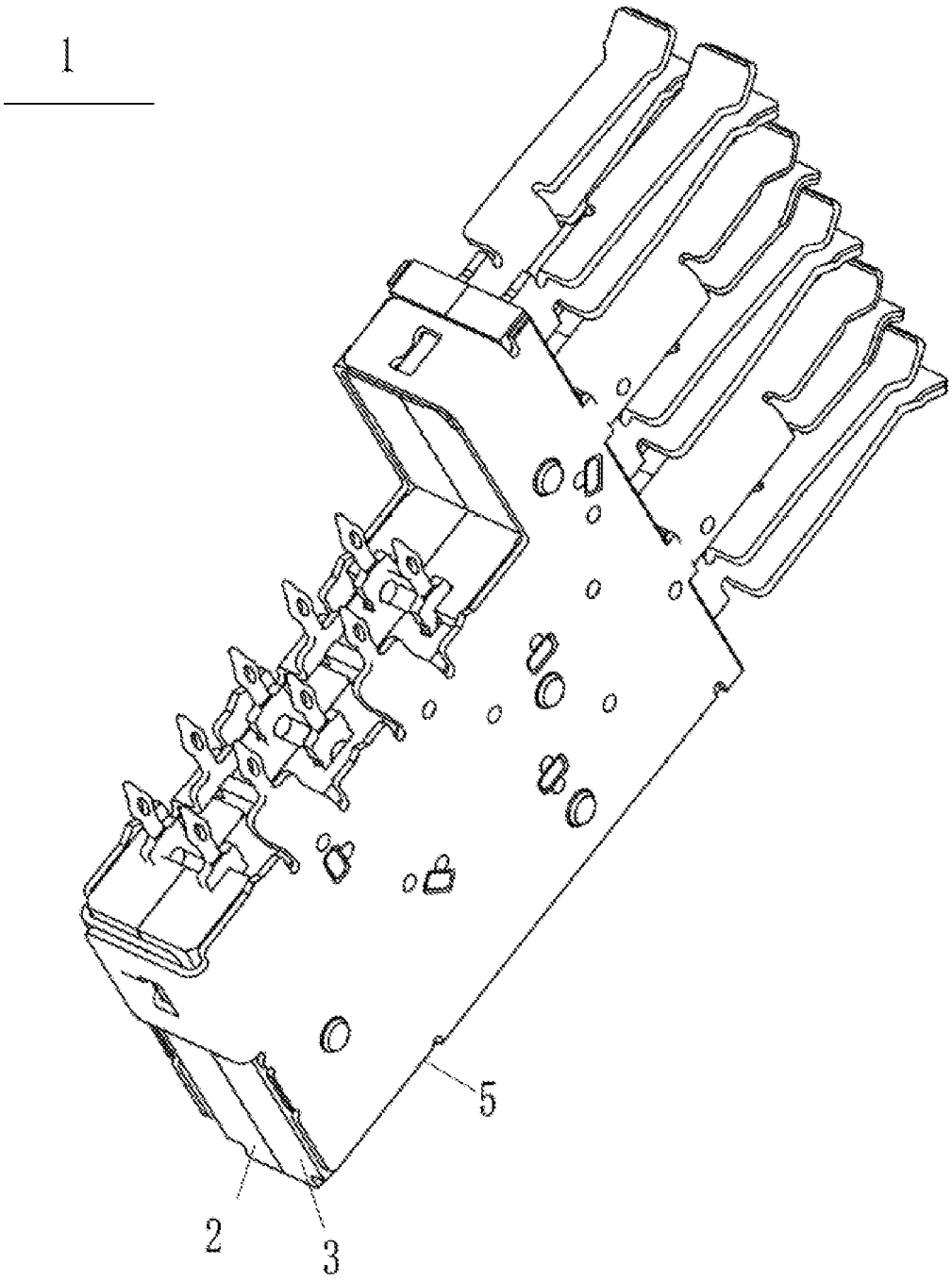
FIG. 15 is a structural schematic diagram of a terminal assembly of the second embodiment of the present disclosure.
Figure 16:
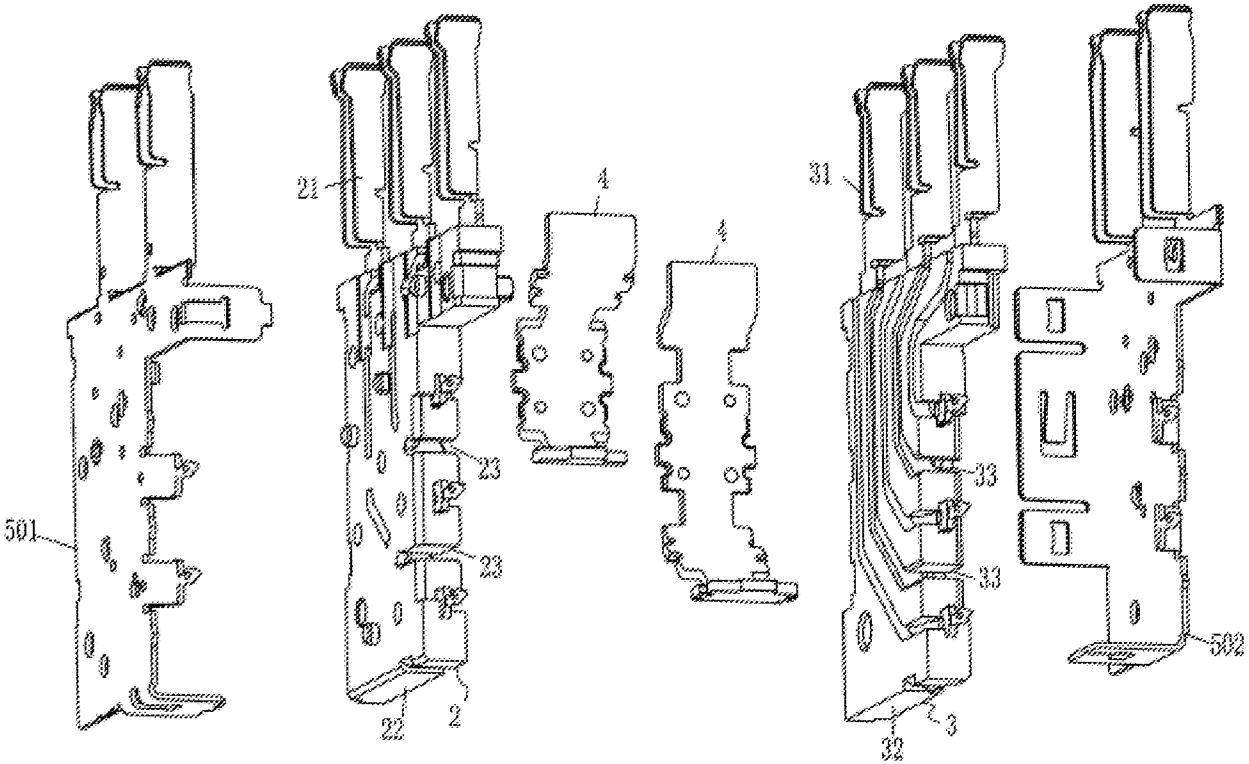
FIG. 16 is an exploded view of the terminal assembly of the second embodiment of the present disclosure.

In the second embodiment of the present disclosure, FIG. 15 is a structural schematic diagram of a terminal assembly of the second embodiment of the present disclosure. FIG. 16 is an exploded view of the terminal assembly of the second embodiment of the present disclosure. As shown in the figures, the terminal assembly 1 of this embodiment is different from that of the first embodiment in that the first terminal component 2 comprises a first insulating body 22 and three first signal terminals 21 embedded in the first insulating body 22. The first insulating body 22 and the three first signal terminals 21 are integrated as an integral member through injection molding. The first insulating body 22 comprises two first through grooves 23 respectively disposed between two adjacent first signal terminals 21 of the three first signal terminals 21 at an interval.

The second terminal component 3 comprises a second insulating body 32 and three second signal terminals 31. The three second signal terminals 31 are embedded in the second insulating body 32. The second insulating body 32 and the three second signal terminals 31 are integrated as an integral member through injection molding. The second insulating body 32 comprises two second through grooves 33 respectively disposed between two adjacent second signal terminals 31 of the three second signal terminals 31 at an interval. The two second through grooves 33 corresponds to the two first through grooves 23, respectively.

The number of metal shielding plates 4 is two. The two metal shielding plates 4 are respectively disposed in the corresponding first through groove 23 and second through groove 33. The metal housing 5 covers the first terminal component 2, the second terminal component 3, and the two metal shielding plates 4. The two opposite sides of the two metal shielding plates 4 are connected to the metal housing 5.

Since the first terminal component 2 and the second terminal component, 3 are injection molded components, when assembling the terminal assembly, it is only necessary to install the first terminal component 2, the two metal shielding plate 4, and the second terminal component 3 in the metal housing 5 in order, followed by secure-connecting the two metal shielding plate 4 with the metal housing 5 by soldering. This would simplify the assembling process, enhance the assembling efficiency, and achieve automated manufacturing.

It should be understood that, in the foregoing, only two first signal terminals 21 and two second signal terminals 31, and only three first signal terminals 21 and three second signal terminals 31 are respectively taken as examples for the description of the plurality of first signal terminals 21 and the plurality of second signal terminals 31, but the present disclosure is not limited thereto. The number of the plurality of first signal terminals 21 and the number of the plurality of second signal terminals 31 could be any other numbers. For example, the number of the plurality of first signal terminals 21 could be four, five, six or more than six, and the number of the plurality of second signal terminals 31 could be four, five, six or more than six.

Figure 17:
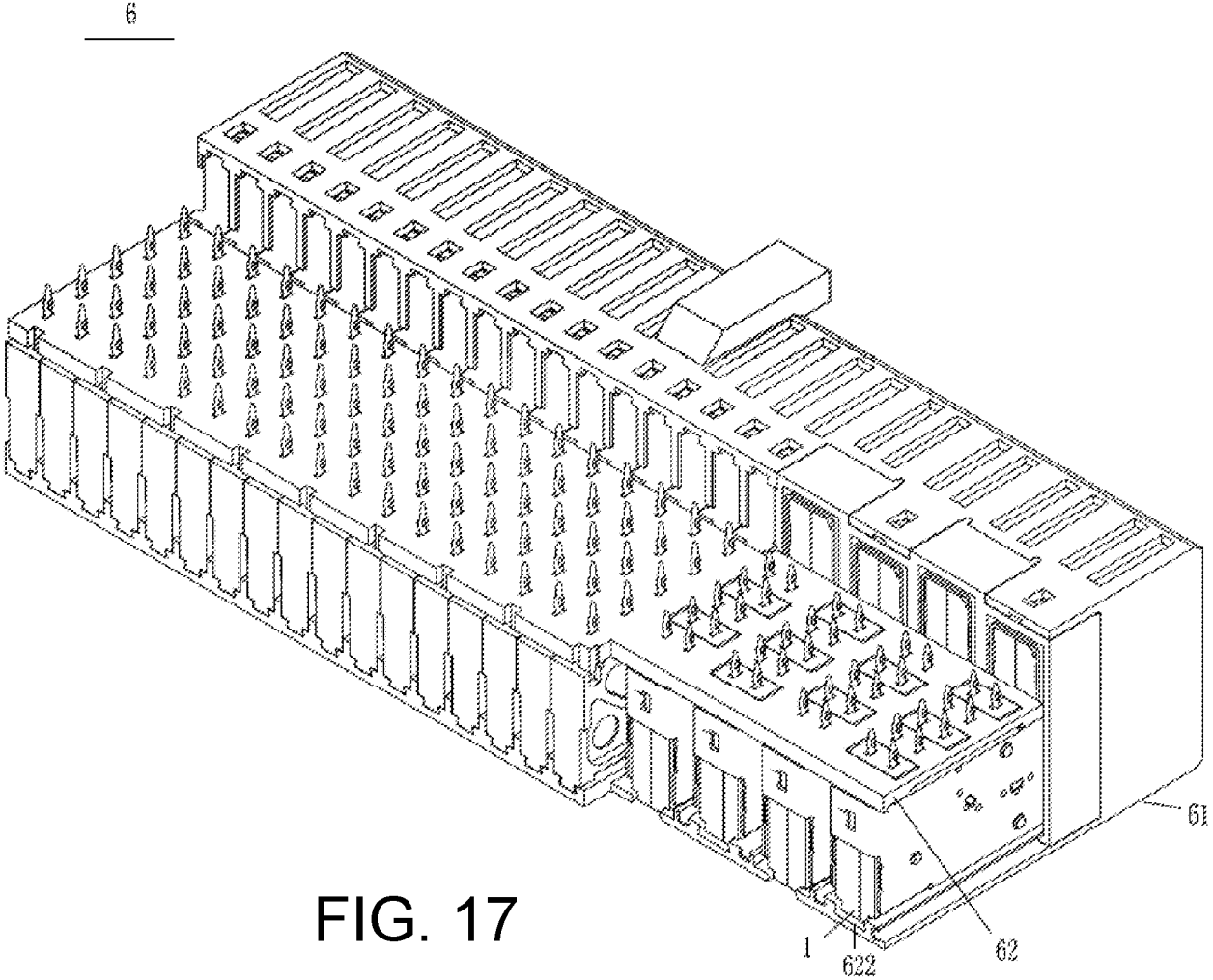
FIG. 17 is a structural schematic diagram of a connector of the third embodiment of the present disclosure.

In the third embodiment of the present disclosure, FIG. 17 is a structural schematic diagram of a connector of the third embodiment of the present disclosure. As shown in the figure, a connector 6 comprises an insulative housing 61 and at least two terminal assemblies 1 according to any form of the first embodiment mentioned above, and the terminal assemblies 1 are arranged on inner left and right sides of the insulative housing 61.

Figure 18:
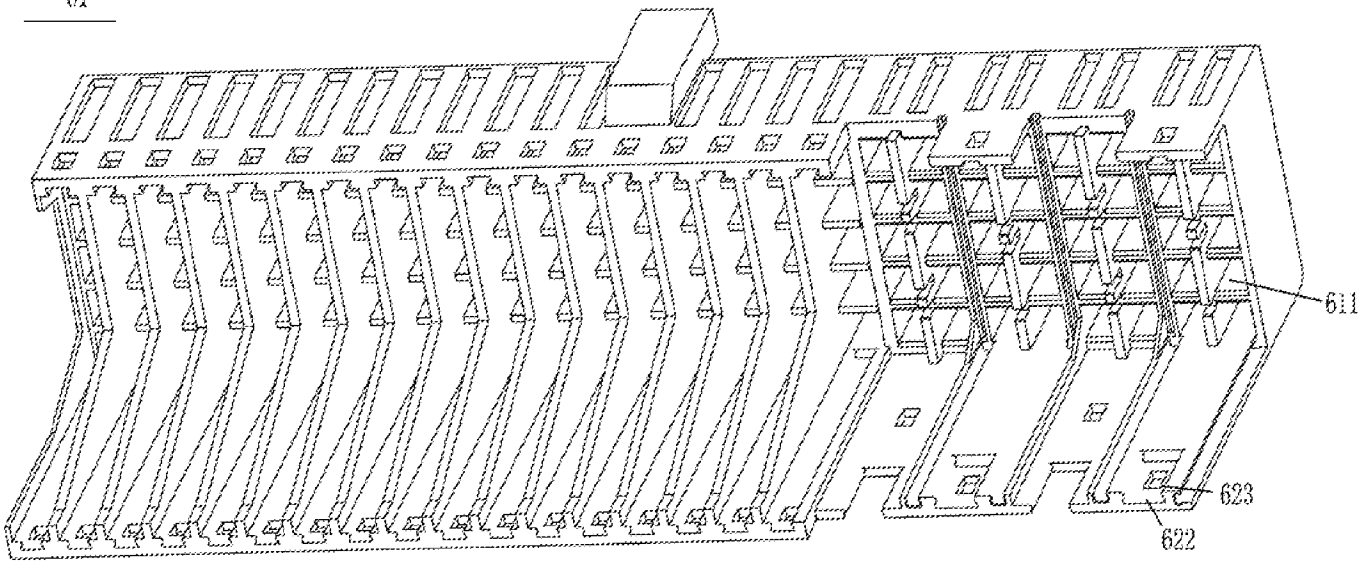
FIG. 18 is a structural schematic diagram of an insulative housing of the third embodiment of the present disclosure.

Practically, the connector 6 further comprises a partition plate 62. The terminal assembly 1 is disposed between the insulative housing 61 and the partition plate 62. FIG. 18 is a structural schematic diagram of an insulative housing of the third embodiment of the present disclosure. As shown in FIG. 17 and FIG. 18, the number of the terminal assemblies 1 is four, and the insulative housing 61 comprises a plurality of insertion holes 611. The insulative housing 61 is provided with a limiting gap 622 corresponding to the first engaging bump 224 and the second engaging bump 325 of each of the terminal assemblies 1, and is provided with a limiting opening 613 corresponding to the elastic arm 225 of each of the terminal assemblies 1.

It can be seen that the four terminal assemblies 1 are installed on the insulative housing 61, and the signal terminals of the four terminal assemblies 1 are correspondingly inserted in the insertion holes 611. The first engaging bump 224 and the second engaging bump 325 are disposed in the limiting gap 622. The elastic arm 225 abuts against a sidewall of the corresponding limiting opening 613. The partition plate 62 covers the four terminal assemblies 1.

It should be noted that only the above configuration is taken as an example for the description of one of the plurality of connectors 6, but the present disclosure is not limited thereto. Those skilled in the art can also select other configurations of the connector 6 including the terminal assembly 1 of the present disclosure according to the teaching of this embodiment.

In summary, the present disclosure proposed a terminal assembly and connector. When assembling the terminal assembly, it is only necessary to install the first terminal component, the metal shielding plate, and the second terminal component in the metal housing in order, followed by secure-connecting the metal shielding plate with the metal housing by soldering. The present disclosure provides a terminal assembly with a limited amount of parts, which could simplify the assembling process, enhance the assembling efficiency, achieve automated manufacturing, and significantly improve the assembling quality.

It is to be understood that the term "comprises", "comprising", or any other variants thereof, is intended to encompass a non-exclusive inclusion, such that a process, method, article, or device of a series of elements not only include those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A terminal assembly, comprising:

a first terminal component comprising a plurality of first signal terminals and a first insulating body, the first signal terminals being embedded in the first insulating body;

a second terminal component comprising a plurality of second signal terminals and a second insulating body, the second signal terminals being embedded in the second insulating body, the second terminal component being disposed opposite to the first terminal component;

at least one metal shielding plate connecting with the first terminal component and the second terminal component, the metal shielding plate being disposed between the two adjacent first signal terminals and between the two adjacent second signal terminals; and a metal housing covering the first terminal component, the second terminal component and at least one of the metal shielding plates, at least one of the metal shielding plates being connected to the metal housing;

wherein the metal housing comprises:

a first housing disposed on the first terminal component; on the periphery of the first housing is provided with a plurality of first flanges, each of which comprises a buckle opening; and a second housing disposed on the second terminal component on the periphery of the second housing is provided with a plurality of second flanges, each of which comprises a buckle corresponding to the buckle opening of each of the first flanges; each of the second flanges covers the corresponding first flange; each of the buckles correspondingly buckles into each of the buckle openings;

wherein an end part of each of the first flanges facing the second housing comprises a guiding member; each of the guiding members extends in a direction away from the corresponding second flange; a side surface of the second insulating body is provided with a plurality of guiding grooves; each of the guiding members is disposed in the corresponding guiding groove.

2. The terminal assembly according to claim 1, wherein the first insulating body comprises at least one first through groove; the second insulating body comprises at least one second through groove;

wherein each of the metal shielding plates is disposed in the corresponding first through groove and the second through groove; each of the metal shielding plates is connected to the metal housing.

3. The terminal assembly according to claim 2, wherein two opposite sides of the metal shielding plate respectively comprise a plurality of third positioning columns exposed from at least one of the first through grooves and at least one of the second through grooves, the metal housing comprises a plurality of third positioning holes disposed in the corresponding third positioning holes.

4. The terminal assembly according to claim 2, wherein at least one first connecting bridge is disposed on one side of each of the first through grooves close to the metal housing; at least one second connecting bridge is disposed on one side of each of the second through grooves close to the metal housing; two sides of the metal shielding plate comprise a notch corresponding to the at least one first connecting bridge and the at least one second connecting bridge; the two sides of the metal shielding plate are tenoned onto the at least one first connecting bridge and the at least one second connecting bridge through the notches.

5. The terminal assembly according to claim 1, wherein an inner surface of the metal housing comprises a plurality of soldering bumps soldered to be fixed onto an inner surface of the metal shielding plate.

6. The terminal assembly according to claim 1, wherein one end of the buckle close to the inner side of the second housing comprises an abutting surface abutting against a sidewall of the buckle opening close to the second housing.

7. The terminal assembly according to claim 6, wherein the buckle opening comprises an insertion part and a positioning part; the buckle enters the positioning part through the insertion part; the abutting surface abuts against a sidewall of the positioning part; the width of the positioning part is greater than the width of the insertion part; a side edge of the insertion part abuts against two opposite surfaces of the buckle perpendicular to the abutting surface.

8. The terminal assembly according to claim 1, wherein a plurality of elastic pieces is disposed on at least one of the plurality of first flanges; the plurality of elastic pieces are in contact with an inner surface of the corresponding second flange.

9. The terminal assembly according to claim 1, wherein a plurality of second positioning columns are respectively disposed on a surface of the first insulating body away from the second insulating body and on one side of the second insulating body away from the first insulating body; a plurality of second positioning holes are disposed on the first housing and the second housing; each of the second positioning columns is inserted into the corresponding second positioning hole; the second positioning column is a hot melt column.

10. A connector, comprising:

an insulative housing; and at least two terminal assemblies, comprising:

a first terminal component comprising a plurality of first signal terminals, the first signal terminals being embedded in a first insulating body;

a second terminal component comprising a plurality of second signal terminals and a second insulating body, the second signal terminals being embedded in the second insulating body, the second terminal component being disposed opposite to the first terminal component;

at least one metal shielding plate connecting with the first terminal component and the second terminal component, the metal shielding plate being disposed between the two adjacent first signal terminals and between the two adjacent second signal terminals; and a metal housing covering the first terminal component, the second terminal component and at least one of the metal shielding plates, at least one of the metal shielding plates being connected to the metal housing;

wherein the terminal assemblies are arranged on inner left and right sides of the insulative housing;

wherein the metal housing comprises:

a first housing disposed on the first terminal component; on the periphery of the first housing is provided with a plurality of first flanges, each of which comprises a buckle opening; and a second housing disposed on the second terminal component on the periphery of the second housing is provided with a plurality of second flanges, each of which comprises a buckle corresponding to the buckle opening of each of the first flanges; each of the second flanges covers the corresponding first flange; each of the buckles correspondingly buckles into each of the buckle openings;

wherein an end part of each of the first flanges facing the second housing comprises a guiding member; each of the guiding members extends in a direction away from the corresponding second flange; a side surface of the second insulating body is provided with a plurality of guiding grooves; each of the guiding members is disposed in the corresponding guiding groove.

11. The terminal assembly according to claim 10, wherein the first insulating body comprises at least one first through groove; the second insulating body comprises at least one second through groove;

wherein each of the metal shielding plates is disposed in the corresponding first through groove and the second through groove; each of the metal shielding plates is connected to the metal housing.

12. The terminal assembly according to claim 11, wherein two opposite sides of the metal shielding plate respectively comprise a plurality of third positioning columns exposed from at least one of the first through grooves and at least one of the second through grooves, the metal housing comprises a plurality of third positioning holes disposed in the corresponding third positioning holes.

13. The terminal assembly according to claim 11, wherein at least one first connecting bridge is disposed on one side of each of the first through grooves close to the metal housing; at least one second connecting bridge is disposed on one side of each of the second through grooves close to the metal housing; two sides of the metal shielding plate comprise a notch corresponding to the at least one first connecting bridge and the at least one second connecting bridge; the two sides of the metal shielding plate are tenoned onto the at least one first connecting bridge and the at least one second connecting bridge through the notches.

14. The terminal assembly according to claim 10, wherein an inner surface of the metal housing comprises a plurality of soldering bumps soldered to be fixed onto an inner surface of the metal shielding plate.

15. The terminal assembly according to claim 10, wherein a plurality of second positioning columns are respectively disposed on a surface of the first insulating body away from the second insulating body and on one side of the second insulating body away from the first insulating body; a plurality of second positioning holes are disposed on the first housing and the second housing; each of the second positioning columns is inserted into the corresponding second positioning hole; the second positioning column is a hot melt column.

* * * * *